United States Patent [19]

Cerveny et al.

[11] Patent Number: 4,526,285

[45] Date of Patent: Jul. 2, 1985

[54] COLLAPSIBLE BASKET

[75] Inventors: Leonard W. Cerveny, Kent; Christopher Bonham, Seattle; J. C. Mull, Jr., Mount Lake Terrace; Jon V. Shellman, Seattle, all of Wash.

[73] Assignee: Pacific Wire Works, Inc., Seattle, Wash.

[21] Appl. No.: 543,094

[22] Filed: Oct. 18, 1983

[51] Int. Cl.[3] ..... B65D 6/18; B65D 6/08

[52] U.S. Cl. ..... 220/7; 220/19

[58] Field of Search ..... 220/6, 7, 19; 217/15, 217/47

[56] References Cited

U.S. PATENT DOCUMENTS

| | | | |
|---|---|---|---|
| 1,432,454 | 10/1922 | Geraci | 220/6 |
| 1,443,836 | 1/1923 | Digby | 220/6 |
| 1,443,901 | 1/1923 | Murray | 220/6 |
| 1,478,695 | 12/1923 | Bilbrey | 220/6 |
| 1,626,009 | 4/1927 | Murray | 220/19 |
| 1,795,942 | 3/1931 | Flagstad | 220/6 |
| 2,171,690 | 9/1939 | Garber | 217/47 |
| 2,456,419 | 12/1948 | Jackson | 220/6 |
| 2,832,499 | 4/1958 | Maslow | 220/19 |
| 3,202,295 | 8/1965 | Drader | 220/19 |
| 3,378,161 | 4/1968 | Lookabaugh | 220/19 |

FOREIGN PATENT DOCUMENTS

| | | | |
|---|---|---|---|
| 666100 | 2/1952 | United Kingdom | 220/19 |
| 387887 | 11/1973 | U.S.S.R. | 220/7 |

*Primary Examiner*—George E. Lowrance

*Attorney, Agent, or Firm*—Kolisch, Hartwell & Dickinson

[57] ABSTRACT

A collapsible basket is provided which includes the following components: a bottom wall; a plurality of side walls mounted to the bottom wall, each of the side walls being upwardly and inwardly pivotable between a flattened position extending substantially co-planar to the bottom wall, and a raised position extending substantially normal thereto; an abutment disposed between adjacent side walls for limiting the inward pivotal travel when the side walls are in the raised position; a tab extending upwardly from each of the side walls; and a peripheral clamp disposable adjacent the side walls, encompassing the tabs to fix the position of the side walls between the clamp and the abutment.

7 Claims, 4 Drawing Figures

COLLAPSIBLE BASKET

BACKGROUND OF THE INVENTION

1. Field of the Invention

This invention relates generally to collapsible containers and, more particularly, to a container formed of wire-like members which may be nested for holding or storage of materials, and which may be collapsed to a substantially planar condition for storage.

2. Discussion of the Prior Art

Collapsible containers constructed of wire-like rods have been in use for many years. One example is shown in U.S. Pat. No. 1,443,901 to Murray. This patent discloses a container having pivotal walls which permit collapse to a planar condition. To transform the container to its assembled or erected mode, the side walls are pivoted upwardly, and an engagement rod is used to fix adjacent side walls together. A plurality of eyes extend upwardly from the upper periphery of the side walls to permit the top of the container to be wired shut. A variation of Murray's container is disclosed in his U.S. Pat. No. 1,626,009.

While Murray's container may be collapsed to a planar state, in this state the container is widely spread out and therefore is not very compact. Also, nothing is included in the Murray patents to suggest that the containers are specifically adapted to be nestible, that is stackable one upon the other. Moreover, to assemble his container, Murray's use of separable rods presents the danger that the rods may be misplaced, and may require the use of tools.

Other collapsible containers are disclosed in U.S. Pat. Nos. 4,005,795 and 4,235,346 to Mikkelsen, et al. and Liggett, respectively. Both of these patents disclose containers which are collapsible to a planar condition, but again, in this condition, the containers are widely spread out. Mikkelson does teach the use of a plurality of so-called fingers which are adapted to clip adjacent walls to one another when the container is transformed to its assembled mode. However, like the Murray patents, nothing in the Mikkelsen et al. or Liggett patents discloses that the containers are specifically adapted to be nestible.

U.S. Pat. No. 3,419,175 to Laughlin et al. discloses a baking pan frame adapted to receive a plurality of disposable foil-like pan sections, which are fixed in place by a pivotable, peripheral closure member which secures the pan sections between such member and the container frame. Laughlin's apparatus is shown to be nestible, but only in an inoperable mode. U.S. Pat. Nos. 797,871 and 645,344 to Smith and White, respectively, exemplify other attempts to develop collapsible baskets comprised of wire-like members.

It is an object of the present invention to provide a collapsible container which overcomes the drawbacks and limitations of the prior art proposals. More specifically, the present invention has the following as its objects: (1) to develop a basket formed of wire-like components which can be folded over itself to be collapsed to a compact, substantially planar condition; (2) to provide a collapsible basket which is erectable into a sturdy, relatively shallow basket which may be nested with a plurality of like baskets so that items may be temporarily stored such that air can surround and permeate the items and so that the items are not crushed; (3) the development of a collapsible basket which is simple in construction and therefore inexpensive to manufacture and maintain; (4) the provision of a collapsible basket which is self-contained so that no additional parts have to be used to erect the basket, thus eliminating the possibility of parts lost, and which is easily erectable and collapsible without requiring tools or experience or skill on the part of the operator.

SUMMARY OF THE INVENTION

The present invention achieves the above objects by providing a collapsible basket which includes the following components: a bottom wall; a plurality of side walls, each of which is upwardly and inwardly pivotable between a flattened condition extending substantially co-planar to the bottom wall, and a raised position, extending substantially normal to it; abutment means disposed between adjacent side walls for limiting the inward pivotal travel of the adjacent side walls when the side walls are in the raised position; tab means extending upwardly from the side walls beyond the upper periphery thereof; and peripheral clamp means disposable over each side wall, encompassing the tab means to fix the position of the side wall between the clamp means and the abutment means.

Another aspect of this invention is a method for forming a basket having a bottom wall, a plurality of side walls pivotally mounted thereto and having a tab extending upwardly therefrom, and abutment means disposed between adjacent side walls to limit the inward pivoting of the side walls. The method of the invention encompasses the tabs with peripheral clamp means to hold the side walls in abutment with the abutment means.

The invention thus provides a basket which may be collapsed to a flat, compact mode, yet which is easy to erect into a self-supporting mode without the use of additional parts, tools or skill. The basket is capable of being nested with other like baskets, so that items contained therein may be adequately spaced from one another to prevent crushing and to facilitate air circulation. Other objects, features and advantages of the invention will become apparent upon reading the following detailed description in conjunction with the accompanying drawings.

DETAILED DESCRIPTION OF A PREFERRED EMBODIMENT

CONSTRUCTION OF THE DEPICTED EMBODIMENT

Figure 1:
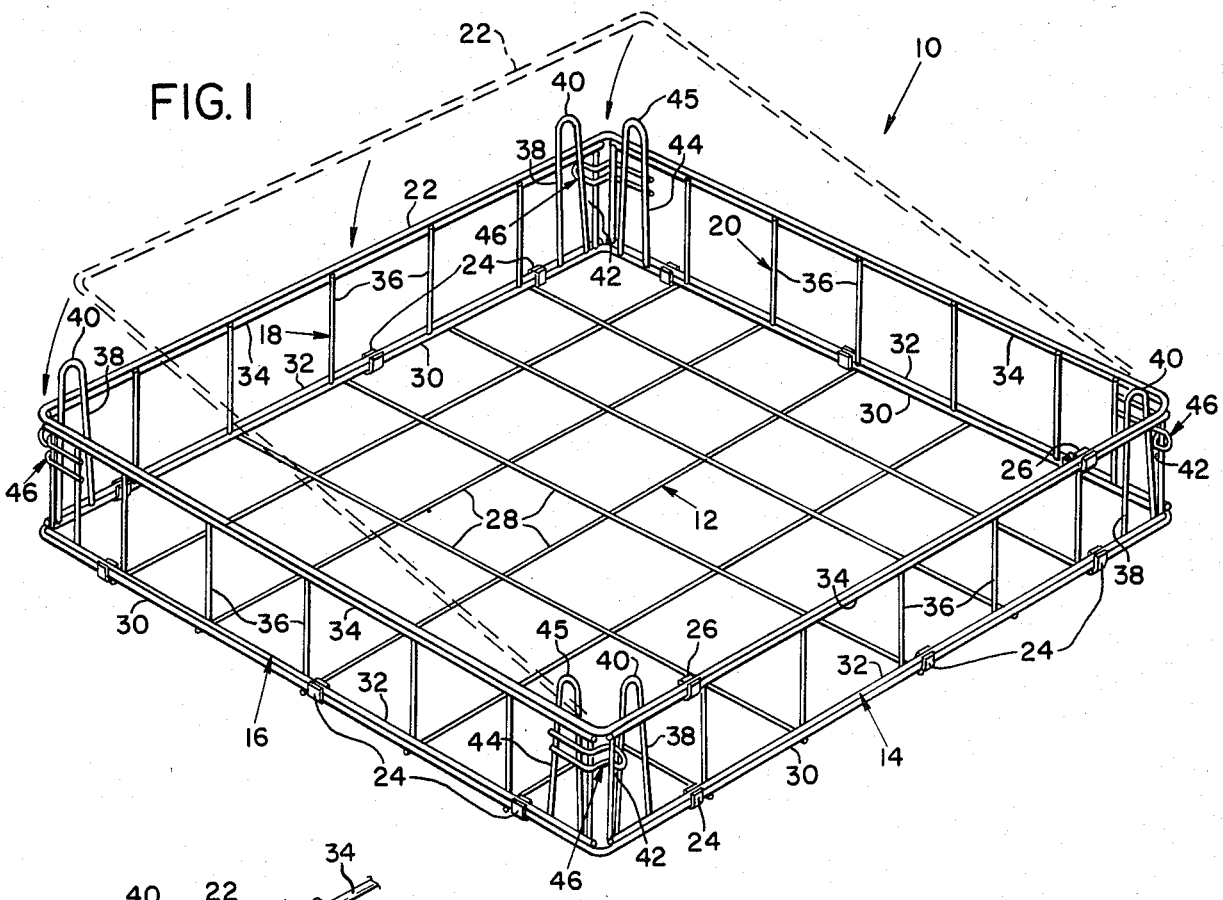
FIG. 1 is a perspective view of one embodiment of the present invention in the erected mode, showing in solid lines the clamp ring in its lowered position, and in phantom in a slightly pivotally raised position.
Figure 2:
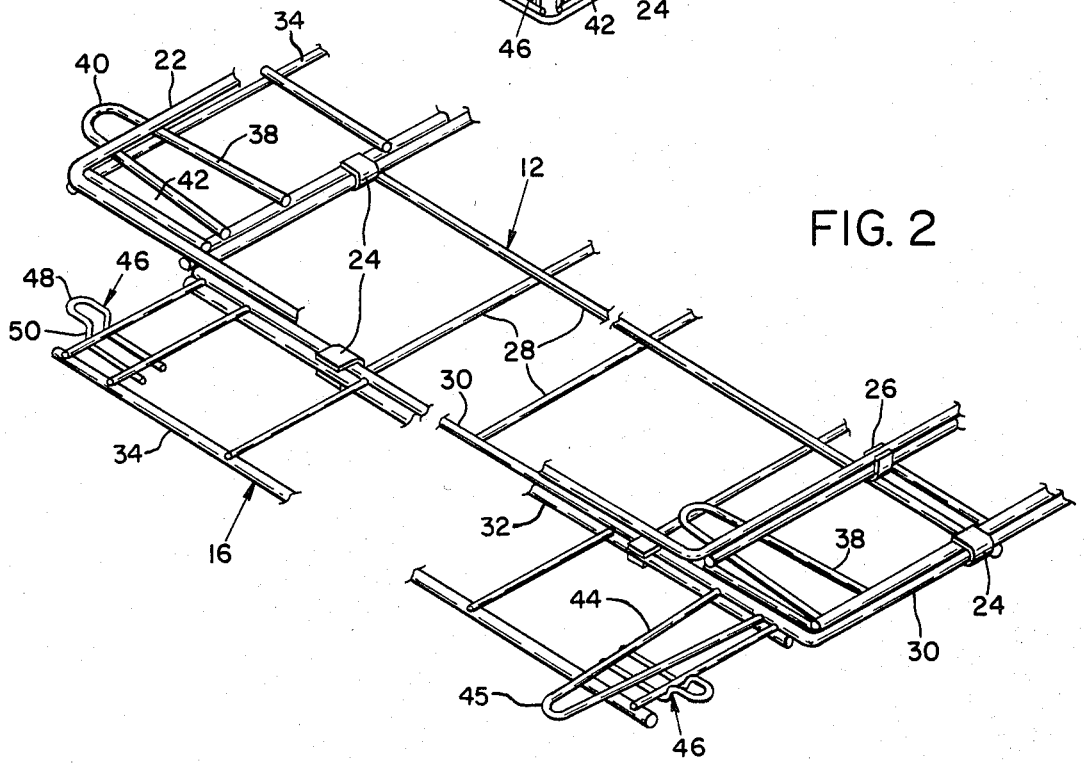
FIG. 2 is a fragmentary perspective view of the embodiment of FIG. 1 in the collapsed mode.
Figure 3:
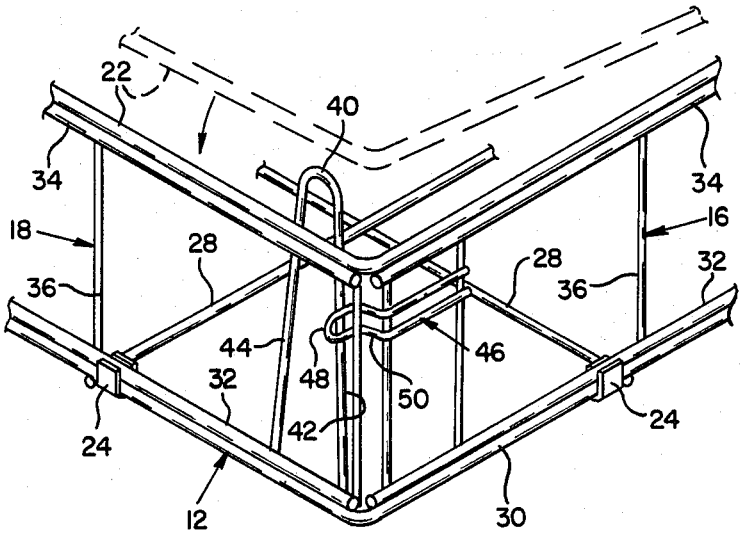
FIG. 3 is a fragmentary perspective view showing one corner of the embodiment of FIG. 1 in the erected mode, with the clamp ring being shown in solid lines in its lowered position, and in phantom in a slightly pivotally raised position.
Figure 4:
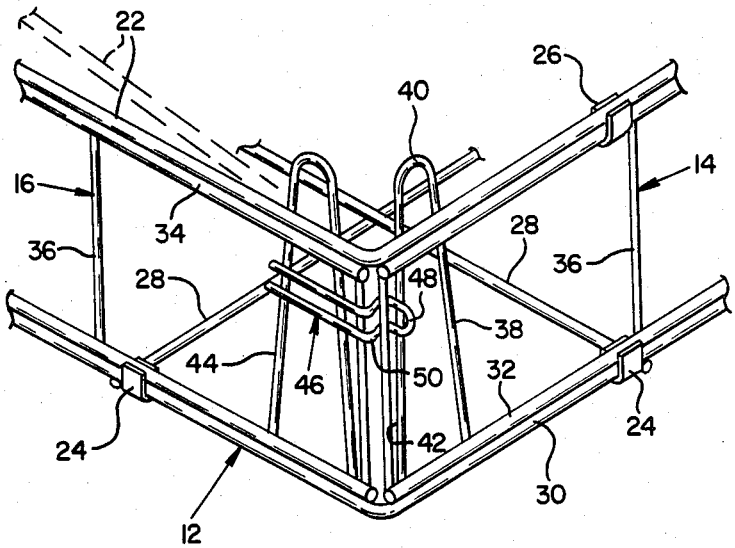
FIG. 4 is a fragmentary perspective view of another corner of the embodiment of FIG. 1 in its erected mode, again showing the clamp ring in its lowered position in solid lines, and in phantom in a slightly pivotally raised position.

The objects of the present invention are particularly well achieved when the invention takes the form of the embodiment depicted in FIGS. 1–4, generally indicated with the numeral 10. FIGS. 1, 3 and 4 depict basket 10 in its erected mode, while FIG. 2 shows it in its planar or collapsed mode. Basket 10 consists essentially of a bottom wall 12, four side walls 14, 16, 18 and 20, and a clamp ring 22. Side walls 14, 16, 18 and 20 are pivotally mounted to the four sides of the generally rectangular bottom wall 12 by a plurality of spaced U-shaped brackets 24. Similar U-shaped brackets 26 pivotally mount clamp ring 22 to one of the side walls, here side wall 14.

Bottom wall 12 is formed of a plurality of relatively rigid, wire-like cross members 28 which extend between four bottom wall peripheral members 30. In the depicted embodiment, bottom wall peripheral members 30 are shown to be a single continuous rod, bent at the corners, but the members may alternatively take the form of separate components.

Side walls 14, 16, 18 and 20 are similarly formed of a plurality of relatively rigid wire-like members. Upwardly extending members 36 are mounted at evenly spaced intervals between lower side wall peripheral members 32 and upper side wall peripheral members 34. The previously mentioned U-shaped brackets 24 are affixed, such as by welding, to lower side wall peripheral members 32 and extend around bottom wall peripheral members 30, but are not rigidly affixed to the latter so that the side walls are permitted to pivot with respect to the bottom wall.

Side walls 14 and 18 are typically of identical construction, as are side walls 16 and 20. Side walls 14 and 18 each includes a pair of looped members 38 disposed adjacent each end of these two side walls. Looped members 38 terminate above the upper periphery of side walls 14 and 18, this portion being referred to as a tab 40, the purpose of which will be discussed below. As seen best in FIGS. 3 and 4, looped members 38 are affixed, such as by welding, to the inner side of lower and upper side wall peripheral members 32 and 34, again for purposes to be discussed below. Looped members 38 are not affixed to clamp ring 22. At each end of side walls 14 and 18, a slot 42 is defined between looped members 38 and the endmost side wall upright member 36. The presence of a narrow slot 42 is not essential, but it is important in the depicted embodiment that looped members 38 not be in direct abutment with the endmost side wall upright member 36.

In the depicted embodiment, side walls 16 and 20 include a single looped member 44 disposed adjacent opposite ends of those side walls so that these looped members are disposed diagonally across bottom wall 12, rather than being in alignment adjacent either side wall 14 or 18. Looped members 44 terminate in tabs 45 which extend beyond upper side wall peripheral members 34 in the same fashion as tabs 40 discussed above.

Each side wall 16 and 20 also has a so-called abutment means adjacent each end. In the depicted embodiment, the abutment means takes the form of a substantially Z-shaped clip 46. Each clip 46 includes an extension portion 48 and an abutment portion 50. As shown best in FIGS. 3 and 4, extension portion 48 is adapted to extend through slot 42, while abutment portion 50 is designed to provide an abutment surface against which the end upright members 36 of side walls 14 and 18 may be placed into abutment. Other variations in the positioning of looped members 38 and 44 and clips 46 may be possible as long as they are suitably spaced around the periphery of basket 10, but the depicted design is that which is preferred.

As mentioned above, clamp ring 22 is pivotally mounted to the upper side wall peripheral member 34 of side wall 14 by a plurality, here a pair, of U-shaped brackets 26. U-shaped brackets 26 are typically fixed such as by welding to clamp ring 22, and loosely extend around upper side wall peripheral member 34 of side wall 14 so that the clamp ring is freely pivotal with respect to that side wall. The configuration of clamp ring 22 conforms to the periphery of bottom wall 12 and side walls 14, 16, 18 and 20 when such side walls are disposed in their upright position, depicted in FIGS. 1, 3 and 4. Thus, when clamp ring 22 is in its lowered position, depicted in solid lines in FIGS. 1, 3 and 4, it is in abutment with and rests upon the upper side wall peripheral members 34 of the four side walls. In this lowered position, clamp ring 22 encompasses tabs 40 of the six looped members 38.

Clamp ring 22 is pivotal with respect to upper side wall peripheral member 34 of side wall 14 over a wide angle so that when basket 10 is in a fully collapsed position as depicted in FIG. 2, the clamp ring is permitted to pivot to a position substantially co-planar with side wall 14 and bottom wall 12.

OPERATION OF THE DEPICTED EMBODIMENT

Basket 10 may be used for a wide variety of purposes. It is useful for any situation in which items must be spaced from one another either to prevent crushing or to promote circulation of air. Such spacing is accomplished by using a plurality of baskets 10 which may be nested one upon the other in a stack.

Basket 10 has been found to be particularly suitable for use in the fishing industry because freshly caught fish may be placed in each of a plurality of stacked or nested baskets. The nested baskets loaded with fish are then placed in a so-called blast freezer in which extremely cold air is circulated through the fish to effect freezing. It is therefore imperative in this usage that at least the side walls, and preferably the bottom wall as well, be open to the flow of air to facilitate blast freezing where air circulation through the fish is to be maximized. It is further desirable that the walls of each of the baskets be generally upright so that the flow of air therethrough is not disrupted and formed into vortexes which might concentrate air in particular directions, thereby effecting an uneven rate of freezing of the fish. This freezing process is typically performed on a fish processing ship having very limited storage space. Therefore, the collapsibility feature of the invention is particularly important.

Basket 10 is shown in its collapsed mode in FIG. 2. To transform the basket to its erected mode, side wall 14 is first pivoted upwardly and outwardly beyond the ninety degree point depicted in FIGS. 1, 3 and 4. Clamp ring 22 is also pivoted upwardly to a position somewhat higher than that depicted in phantom in FIG. 1. Side walls 16 and 20 are then pivoted upwardly and inwardly to a position perpendicular to bottom wall 12, side wall 14 then being displaced to a position perpendicular to bottom wall 12. As this is being done, extension portions 48 of each of the clips 46 at the one end of side walls 16 and 20 are directed through slot 42 in side wall 14 causing abutment portions 50 of the clips to contact the endmost side wall upright members 36. This holds side walls 16 and 20 from pivoting either back outwardly or further inwardly, thus maintaining them in the ninety degree position. Side wall 18 is then pivoted upwardly and inwardly to a ninety degree position, causing extension portions 48 of clips 46 at that end of side walls 16 and 20 to pass through slots 42 in side wall 18, at which point abutment portions 50 contact the adjacent side wall upright members 36. It is desirable that the configuration of extension portion 48 be such that there is a friction engagement of the clip extension portion with the endmost side wall upright member 36 so that side wall 18 does not have to be held in place while the next erection step is performed.

To complete assembly, clamp ring 22 is pivoted downwardly as shown in FIG. 1 until the clamp ring rests upon the upper side wall peripheral members 34 of the four side walls. When the components of basket 10 are in this erected position, clamp ring 22 encompasses all six of the tabs 40 and 45 of looped members 38 and 44 which are mounted to the inner periphery of the side walls. This prevents any outward pivoting of the side walls. Specifically, side wall 14 is prevented from outward pivoting because clamp ring 22 is mounted directly to it by U-shaped brackets 26, and the clamp ring is held in position by tabs 40 extending upwardly beyond the upper periphery of side wall 18. Side wall 14 is prevented from pivoting inwardly beyond the ninety degree position by abutment portions 50 of clips 46 extending from that side of side walls 16 and 20.

Side walls 16 and 20 are held from pivoting outwardly by clamp ring 22 which encompasses tabs 40 extending upwardly above the periphery of the side walls, as well as by extension portion 48 of clips 46 at each ends of side walls 16 and 20 which extend through slot 42 and are held from pivoting outwardly by the end side wall upright members 36 at each of side walls 14 and 18.

Side wall 18 is held from pivoting outwardly by clamp ring 22, and from pivoting inwardly by the abutment of the end side wall upright members 36 against abutment portions 50 of the two clips 46 at the adjacent ends of side walls 16 and 20.

In this erected condition, each of the baskets 10 may be loaded with fish or other items, and the baskets may be nested one upon the other. This nesting is facilitated by the fact that tabs 40 extend upwardly beyond clamp ring 22 so that another basket may be placed on top of it, with the tabs of the lower basket extending upwardly through bottom wall 12 of the upper basket. Because of the strength provided by the structure of basket 10, baskets may be stacked to the typical height of a shipboard cooling tunnel. To remove baskets from a stack, they need merely be lifted slightly upwardly to withdraw tabs 40 and 45 from engagement with bottom wall 12 of the upper basket.

When the baskets are no longer in use and need to be stored, they may be transformed to their collapsed mode shown in FIG. 2. To effect collapse, clamp ring 22 is first pivoted to the position depicted in phantom in FIG. 1. The slight friction fit of clips 46 and the outermost side wall upright members 36 of side wall 18 still normally maintains this side wall in its ninety degree position. However, by a slight force, side wall 18 may be lowered to a position substantially co-planar with bottom wall 12. With clamp ring 22 in this raised position, side wall 14 is then pivoted slightly outwardly, thereby releasing side walls 16 and 20 which may be pivoted outwardly to the flattened position shown in FIG. 2 (only side wall 16 appearing in that figure). Side wall 14 may then be pivoted all the way inwardly until it is substantially co-planar with bottom wall 12, at which point clamp ring 22 may be dropped until it also assumes a flattened position, substantially co-planar with the bottom wall, as fragmentarily depicted in FIG. 2.

Thus, with basket 10 in the collapsed mode, not only does the basket take a substantially planar configuration, thereby permitting a large number of baskets to be stacked in a relatively low area, but because clamp ring 22 is, in this mode, disposed over the basket, the length and width dimensions of the collapsed basket are only slightly greater than that of the erected mode.

Of course, it should be understood that various changes and modifications to the preferred embodiment described herein will be apparent to those skilled in the art. Such changes and modifications can be made without departing from the spirit and scope of the present invention and without diminishing its attendant advantages. It is, therefore, intended that such changes and modifications be covered by the following claims.

It is claimed and desired to secure by Letters Patent:

1. A collapsible basket comprising:

a generally rectangular bottom wall;

a plurality of side walls mounted to said bottom wall, each of said side walls being upwardly and inwardly pivotable between a flattened position extending substantially co-planar to said bottom wall, and a raised position extending substantially normal thereto;

abutment means disposed between adjacent ones of said side walls for limiting the inward pivotal travel of said adjacent side walls when said side walls are in the raised position;

tab means extending upwardly from said side walls beyond the upper periphery thereof; and a wire-like peripheral clamp means disposable adjacent said side walls and pivotally mounted to one of said sidewalls to pivot between raised and lowered positions, with said lowered position encompassing and peripherally contacting said tab means to fix the position of said side walls between said clamp means and said abutment means.

2. The basket of claim 1 wherein a side wall is mounted to each edge of said bottom wall, said clamp means substantially conforming to the periphery of said bottom wall.

3. The basket of claim 2 wherein said one side wall to which said clamp means is pivotally mounted includes means for pivoting inwardly to a collapsed mode substantially coplanar with said bottom wall, means further being provided for simultaneously pivoting said clamp means over said bottom wall to a collapsed mode substantially co-planar with said bottom wall.

4. The basket of claim 2 wherein said abutment means comprises a plurality of clips mounted to at least some of said side walls, each said clip having an abutment face against which the adjacent side wall comes into abutment, and an extension portion which extends through said adjacent side wall to facilitate engagement thereof.

5. The basket of claim 4 wherein each of two opposing said side walls includes a pair of said clips, one of which is disposed adjacent each end thereof, the other of said side walls each including an abutment member adjacent each end against which one of said clip abutment faces is adapted to abut, each of said other side walls defining an opening adjacent the ends thereof, through which said clip extension portions are adapted to extend.

6. The basket of claim 1 wherein the basket is nestible with other such baskets, said bottom wall including a plurality of peripheral openings through which said tab means of the basket nested immediately therebelow, extend.

7. The basket of claim 2 wherein each of said tab means extends upwardly from the inward facing side of each of said side walls, said clamp means conforming to the upper periphery of the side walls in their raised position so that said clamp means is adapted to rest on said upper periphery when in its lowered position encompassing said tabs.

* * * * *